United States Patent [19]

Lordier

[11] 4,254,457

[45] Mar. 3, 1981

[54] ILLUMINATED DISPLAY FOR HOUSE NUMBER OR THE LIKE

[76] Inventor: Edgar T. Lordier, 212 Robinwood Ave., Columbus, Ohio 43213

[21] Appl. No.: 30,176

[22] Filed: Apr. 16, 1979

[51] Int. Cl.[3] ..... F21L 7/00

[52] U.S. Cl. ..... 362/367; 362/812

[58] Field of Search ..... 362/812, 367

[56] References Cited

U.S. PATENT DOCUMENTS 2,893,148 7/1959 Figman ..... 362/812 X

*Primary Examiner*—Stephen J. Lechert, Jr.

[57] ABSTRACT

An illuminated sign construction for displaying house numbers or the like that is constructed from simplified multiple function extruded and moulded components that are assembled in sealed relationship, and which are adapted for the mounting of selected indicia on an illuminated face.

7 Claims, 2 Drawing Figures

ILLUMINATED DISPLAY FOR HOUSE NUMBER OR THE LIKE

BACKGROUND OF THE INVENTION

This invention relates to illuminated signs, and more particularly to an illuminated construction for display of a house number or the like.

SUMMARY OF THE INVENTION

In general the present invention comprises an illuminated house number construction that comprises a body portion of novel simplified construction wherein multiple function components thereof consist of simple extruded and molded parts that are readily assembled in sealed relationship.

More particularly, the main body portion is extruded, so as to include integral mounting shoulders for a light pervious front face, as well as mask sections that provide the indicia displayed on the front face.

As another aspect of the present invention the body portion further includes integral mounting shoulders for right and left end closure caps, such that the device can quickly be assembled with the internal components sealed from the environment.

As still another aspect of the present invention, the novel body portion further includes a raceway integrally formed during the extruding process that provides means for mounting the bulb socket and wiring in sealed relationship and at the proper location for effective illumination.

As still another aspect of the present invention, the construction is provided with uniquly mounted riser legs that adapt the device for its location on window sills.

It is therefor a primary object of the present invention to provide a novel illuminated construction for displaying house numbers or the like which construction is uniquely formed from simple multiple function extrusions and mouldings whereby a high degree of economy is achieved with respect to both fabrication of components and assembly thereof.

Further object and advantages of the present invention will be apparent from the following description, reference being had to the accompanying drawings wherein a preferred form of embodiment of the invention is clearly shown.

DESCRIPTION OF THE PREFERRED EMBODIMENT

Figures 1, 2, 5:
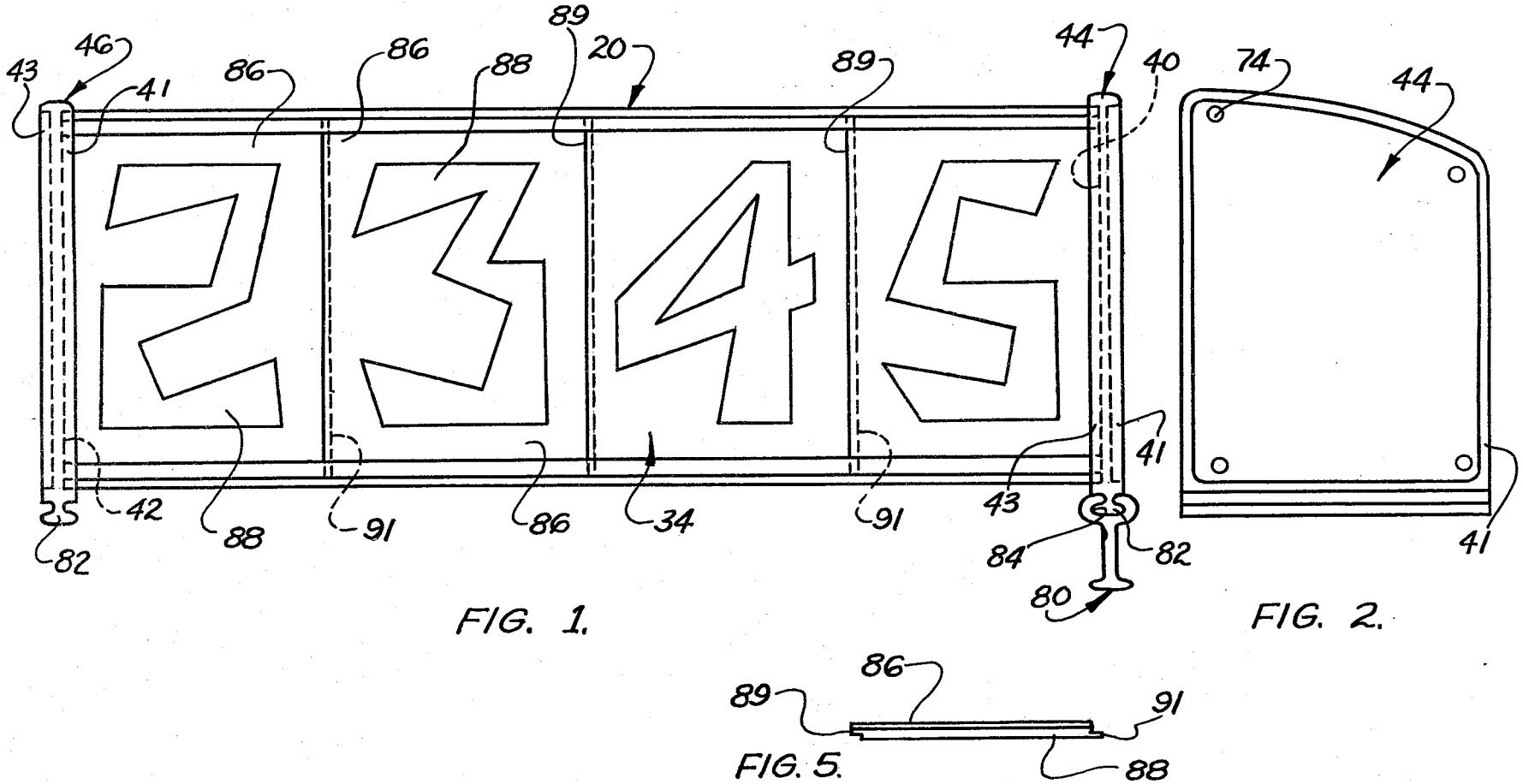
FIG. 1 is a front elevation view of an illuminated construction fabricated in accordance with the present invention.
FIG. 2 is an end elevational view corresponding to FIG. 1.
FIG. 5 is a bottom elevational view of an extruded numeral blank comprising a position for the construction of the preceeding Figures.

Referring in detail to the drawings, an illuminated display device constructed in accordance with the present invention is shown in FIGS. 1 and 2 and comprises a main body means indicated generally at 20. Such body means is of constant cross-sectional shape along its longitudinal axis and is therefor adapted to be fabricated by a continuous extrusion process with simple cut-off operations at intervals along the extruded work piece.

Figure 4:
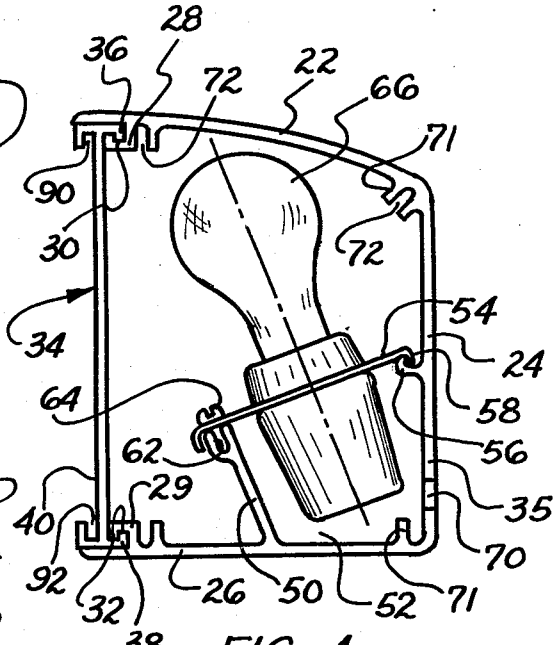
FIG. 4 is an end elevational view, showing the construction of the preceeding Figs. with the end closure caps removed.
Figure 3:
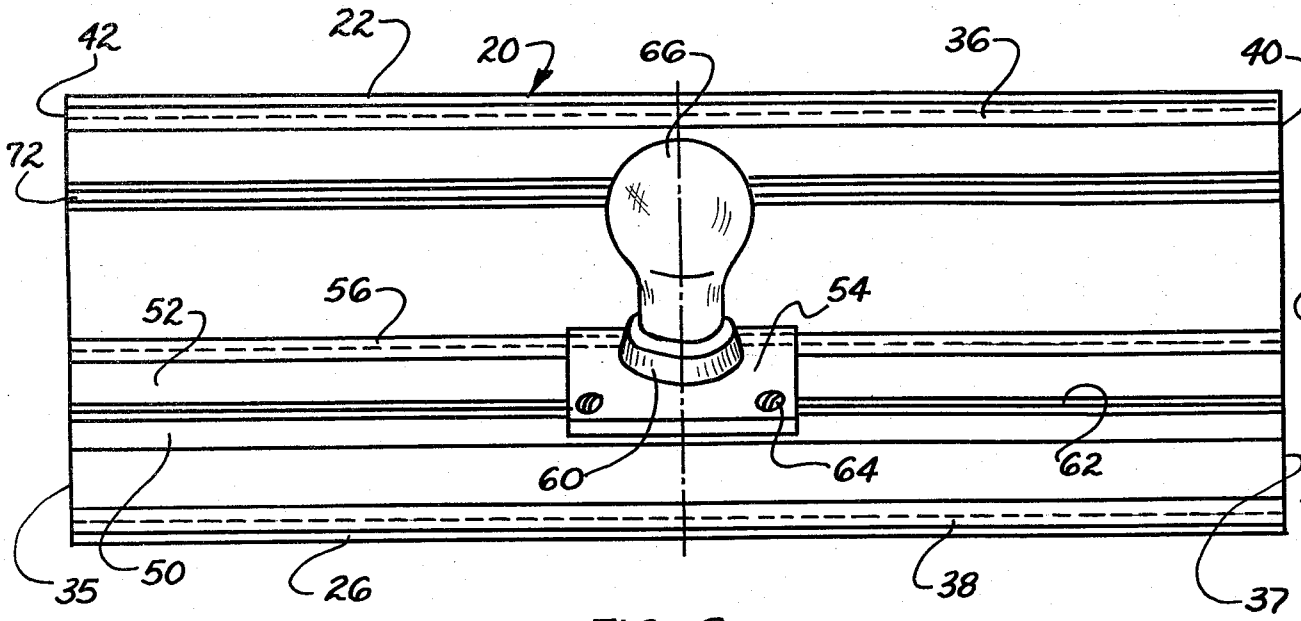
FIG. 3 is a front elevational view of the construction of the preceeding Figures with the front face removed.

As seen in FIGS. 3 and 4, body means 20 includes integrally extruded top, rear and bottom wall portions indicated at 22, 24 and 26 respectively, as well as an upper shoulder 28 forming an upper face mounting slot 30 and a lower shoulder 29 forming a lower face mounting slot 32.

As seen in FIGS. 3 and 4, the corners of the body means includes small continuous ribs 71 that form longitudinal slots 72 for receiving self-tapping screws 74 with such screws being used to mount a right end closure cap 44 and to mount a left end closure cap, as seen in FIGS. 1 and 2.

Each of the caps 44 and 46 are formed as identical castings symetrical with respect to a vertical plane and include peripherally extending cap mounting shoulders 41 and 43 that register with left and right wall edges 35 and 37 on the main body means 20, as well as with right and left face edges 40 and 42 provided on the ends of a light transmitting front face member indicated generally at 34.

As is best seen in FIGS. 3 and 4 front face member 34 is of constant cross-sectional shape, so as to be continuously extrudeable from colored translucent symthetic resinous material, and cut off to lengths corresponding to the length dimension of the main body portion 20.

A suitable and economical material for moulding and extruding the above mentioned parts is medium impact styrene plastic.

Referring again to front face member 34, this part includes an upper face edge 36 adapted to slide into the previously mentioned face mounting slot 30 formed in main body means 20, as well as a lower face edge 38 that slides into the lower face mounting slot 32 in the lower front edge of the body means. Hence the front number 34 can quickly be removeably mounted in place on the body means.

With continued reference to FIGS. 3 and 4, front face member 34 further includes upper and lower extruded shoulders forming upper and lower face member slots 90 and 92 for receiving and mounting indicia blank means in the form of a plurality of numeral indici or blanks one of which is shown at 88 in FIG. 5. Numeral blank 88 is of a constant cross sectional shape, so as to be continuously extruded from clear transparent synthetic resinous material. Next is convenient extruded lengths, multiple controlled opaque background is applied by silk screen process to form an opaque mask 86, leaving a transparent area of numeral blank 88 in the shape of the desired numeral. It will be noted from FIG. 5 that the vertical edges of numeral blanks include offset protrusions 89 and 91 that are adapted to overlap one another when assembled as seen in FIG. 1 such that the edge junctions are sealed against the leakage of light.

Masked numerals 86 are then cut off to lengths corresponding to height formed by slots 90 and 92 and selectively assembled in overlapping edge to edge relationship in above described face mounting slots 90 and 92 in overlying relationship with colored face member 34 thus exposing thrue transparent area 88 the colored translucent face of member 34 in the shape of the desired number.

As an alternate front face construction, a one piece opaque contact vinyl mask is applied to entire surface of face member 34 selective numerals are then cut in mask and removed, leaving an opaque background. While removed area of mask exposes a colored translucent area of face member 34 in the desired shape of numerals.

Referring again to FIGS. 3 and 4, a wiring raceway 52 is provided by intergrally extruded ribs 50 and 56, and a raceway cover 54 mounted on said ribs by self-tapping screws 64 which are screwed into extruded slot 62. Cover 54 is provided with a down-turned rear edge that engages the top edge of rib edge 56 and a conventional socket 60 is mounted on raceway cover 54, such that the light bulb 66 can be positioned and retained at the proper location for efficient illumination of the front face member.

As shown in FIG. 1, the device is provided with riser legs indicated generally at 80 which are fabricated by extruding and cut-off operations, so as to include open ended slots 84 that slideably mount on protrusions 82, the latter being integrally moulded on the bottom edges of end closure caps 44 and 46. Such riser legs adapt the device to be positioned on a window sill at a high enough location, so as to be visible through the pane of a window above the lower frame thereof.

I claim:

1. An illuminated house number construction comprising (an extruded) a main body means comprising (integral) top, rear, end and bottom wall portions, an (upper shoulder) front edge on said top wall portion, forming an upper face mounting shoulder, (slot) a (lower shoulder) front edge on said bottom wall portion forming a lower face mounting (slot, and right and left wall edges) shoulder; a front face member of light transmitting material including upper and lower face edges mounted (in) on said upper and lower shoulders; (slots, and right and left face edges; and right and left closure caps, each of the caps including a peripherally extending cap mounting should that registers with the wall edges and face edge on a respective end of the body means and face member; and fastening means for retaining the closure caps in mounted relationship with the edges.) said face member including a continuous light transmitting surface for selectively mounting an opaque mask forming indicia, and upper and lower face member slots for selectively receiving and mounting light transmitting indicia blank means in overlying relationship with the front face member.

2. An illuminated house number construction comprising, a body means, comprising integral top, rear, end and bottom wall portions, as upper edge on said top wall portion forming an upper face mounting shoulder, a lower edge on said bottom wall portion forming a lower face mounting shoulder; a front face member including upper and lower rear face edge portions respectively mounted on said face mounting shoulders and including upper and lower front face edge portions forming indicia blank mounting slots; and indicia blank means mounted in said indicia blank mounting slots.

3. The construction defined in claim 2 wherein said indicia blank means comprises a plurality of individual light transmitting indicia blanks selectively assembled in the blank mounting slots.

4. The construction defined in claim 2 wherein said indicia blank means comprises a plurality of individual light transmitting indicia blanks selectively assembled in the blank mounting slots, each of said indicia blanks including an edge protrusion along a vertical edge for disposition in overlapping relationship with an edge protrusion on the next adjacent blank.

5. The construction defined in claim 2 wherein said indicia blank means comprises a plurality of individual light transmitting indicia blanks selectively assembled in the blank mounting slots; and an opaque mask mounted on each of said blanks and forming a pattern for the light transmitted through the blank.

6. The construction defined in claim 1 wherein said indicia blank means comprises a plurality of individual light transmitting indicia blanks selectively assembled in the blank mounting slots.

7. The construction defined in claim 1 wherein said indicia blank means comprises a plurality of individual light transmitting indicia blanks selectively assembled in the blank mounting slots; and an opaque mask mounted on each of said blanks and forming a pattern for the light transmitted through the blank.

* * * * *